US005970930A

United States Patent [19]

Scheidt et al.

[11] Patent Number: 5,970,930

[45] Date of Patent: Oct. 26, 1999

[54] DEVICE FOR CHANGING THE OPENING AND CLOSING TIMES OF THE GAS-EXCHANGE VALVES IN AN INTERNAL-COMBUSTION ENGINE

[75] Inventors: Martin Scheidt, Adelsdorf; Dieter Goppelt, Aurachtal; Stefan Hess, Erlangen, all of Germany

[73] Assignee: Ina Wälzlager Schaeffler Ohg, Herzogenaurach, Germany

[21] Appl. No.: 09/051,309

[22] PCT Filed: Jun. 20, 1996

[86] PCT No.: PCT/EP96/02681

§ 371 Date: Apr. 3, 1998

§ 102(e) Date: Apr. 3, 1998

[87] PCT Pub. No.: WO97/17528

PCT Pub. Date: May 15, 1997

[30] Foreign Application Priority Data

Nov. 9, 1995 [DE] Germany ..... 195 41 770

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,080,052 | 1/1992 | Hotta et al. | 123/90.17 |
| 5,301,639 | 4/1994 | Satou | 123/90.17 |

FOREIGN PATENT DOCUMENTS

| | | |
|---|---|---|
| 0 486 068 A3 | 5/1992 | European Pat. Off. . |
| 0 652 354 A1 | 5/1994 | European Pat. Off. . |
| 40 29 849 A1 | 3/1991 | Germany . |
| 44 19 978 A1 | 12/1995 | Germany . |

*Primary Examiner*—Weilun Lo
*Attorney, Agent, or Firm*—Henry M. Feiereisen

[57] ABSTRACT

In a device (1) for varying the opening and closing times of gas exchange valves of an internal combustion engine, an undesired start rattling occurring during the starting operation of the internal combustion engine due to an abutment of an adjusting piston (7) against its end position is to be prevented. For this purpose, the invention provides a coupling means (21) which connects a drive unit (4) and a driven unit (11) during the starting operation of the internal combustion engine.

13 Claims, 3 Drawing Sheets

Fig. 1a
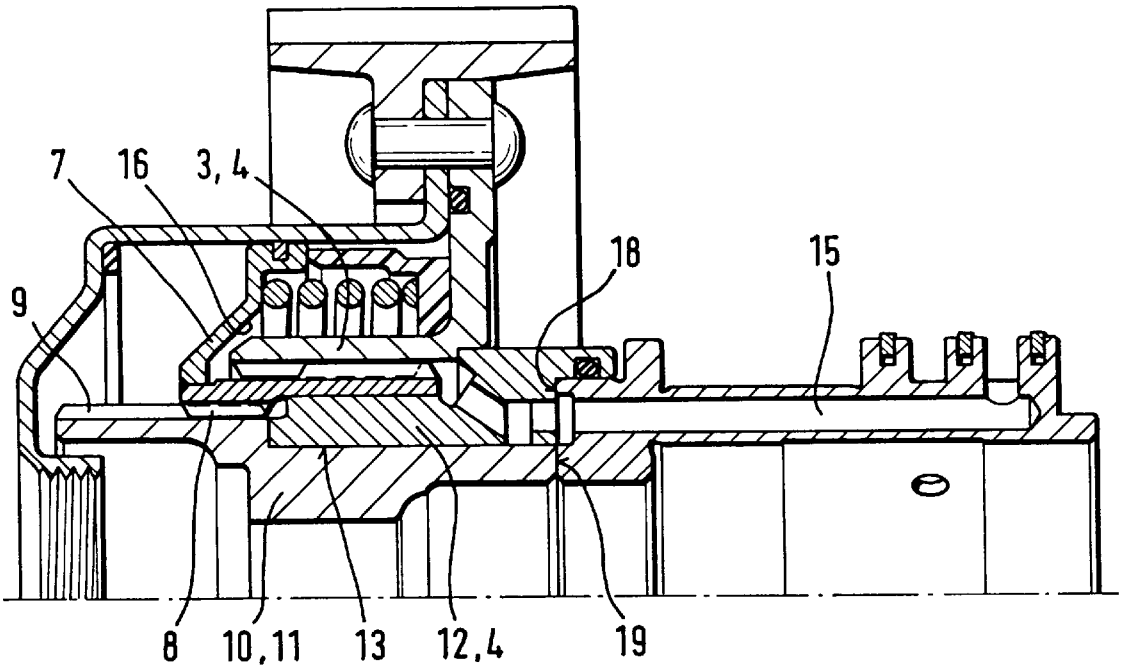
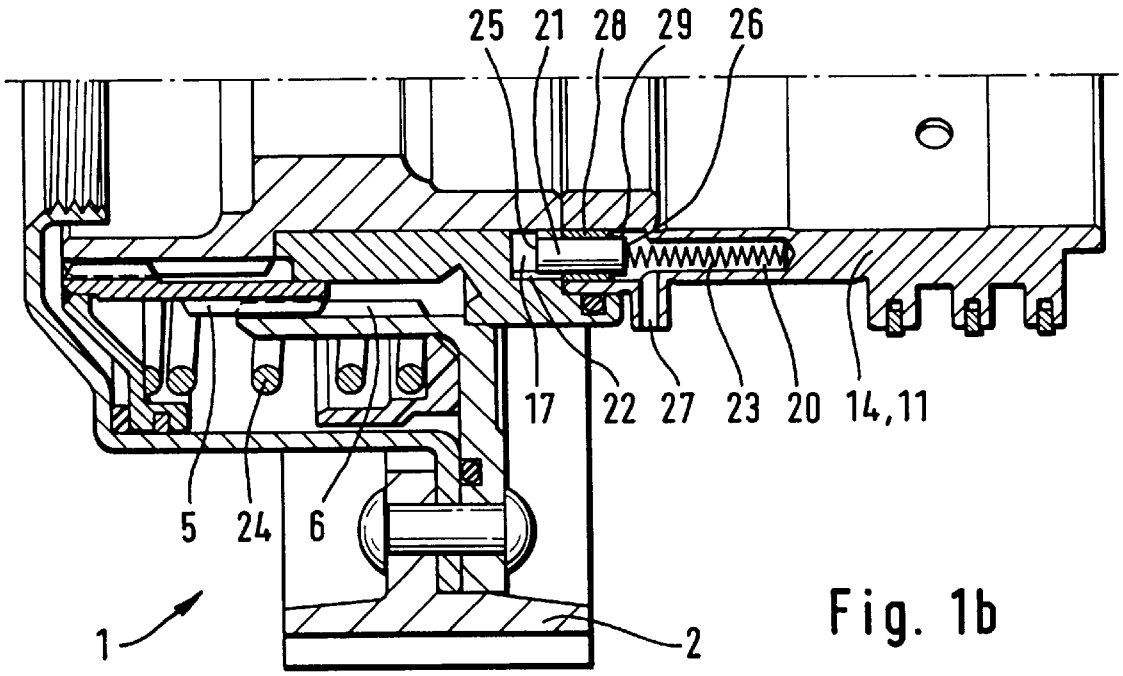
Fig. 1b
Fig. 1

DEVICE FOR CHANGING THE OPENING AND CLOSING TIMES OF THE GAS-EXCHANGE VALVES IN AN INTERNAL-COMBUSTION ENGINE

FIELD OF THE INVENTION

The invention concerns a device for varying the opening and closing times of gas exchange valves of an internal combustion engine, which device is disposed within a control gear of at least one inlet or exhaust camshaft mounted in a cylinder head, with the device being preferably arranged on a drive pinion which is in driving relationship with the camshaft, wherein the device includes an adjusting piston which is axially displaceable by hydraulic medium and possesses two preferably oppositely oriented helical gear sections, the first of which sections cooperates with a complementary gearing of a drive unit which is rotationally fixed to the drive pinion, and the second section cooperates with a complementary gearing of a driven unit which is rotationally fixed to the camshaft, the drive and the driven units comprising opposing end faces.

BACKGROUND OF THE INVENTION

A device of this type is known from DE-PS 29 09 803. With a device of this type, the problem arises on starting of the internal combustion engine, that the adjusting piston concerned moves at a high speed into a position of maximum displacement in which its repeated abutting is accompanied by a considerable amount of noise. This is due to the fact that when the engine has been turned off, the hydraulic medium contained in the device gradually escapes therefrom so that the adjusting piston is no longer sufficiently supported hydraulically although, as a rule, a certain residual amount of hydraulic medium is still present. Due to the torsional vibrations of the camshaft, the adjusting piston, which is now no longer hydraulically supported, is displaced into an end position on re-starting of the engine, with the already mentioned considerable noise generation. This state prevails during the period of time between the ignition of the engine and the filling of the pressure chambers, that is to say, for a few seconds after the engine has been started.

OBJECT OF THE INVENTION

The object of the invention is therefore to create a device of the aforesaid type in which the mentioned drawbacks are eliminated and the indicated start rattling is avoided, particularly with the use of simple means i.e., with only minor constructional measures.

SUMMARY OF THE INVENTION

The invention achieves the above object by providing at least one coupling means arranged preferably parallel to the longitudinal axis of the camshaft extends in a first lodging in one of the two units in the region of the opposing end faces, by providing in the other of the two units a further lodging into which the coupling means can be partly displaced in one relative rotational position of the units by the force of a spring means, wherein the coupling means can be displaced in uncoupling direction into the first lodging with servo assistance such as by hydraulic medium. Advantageous embodiments are the subject matter of the dependent Claims.

The means provided by the invention preclude the rattling noises encountered in the prior art which are caused by a high frequency abutment of the adjusting piston against one of its end positions. As soon as the device has run empty of hydraulic medium to the largest possible extent after the internal combustion engine has been put out of action, the hydraulic support of the adjusting piston is practically non-existent. A compression spring displaces the adjusting piston into the desired start or emergency running position. As a rule, this position in the case of an intake adjuster would be the retard position, and in the case of an exhaust adjuster, the advance position. In an intake adjuster, this movement is assisted by the acting drag and frictional torques of the camshaft. The invention provides that as soon as this position has been reached, the drive and the driven unit of the device are positively coupled to each other. This measure prevents a further axial movement of the adjusting piston until sufficient hydraulic medium pressure has been built up in the device, which pressure disengages a coupling means which is instrumental in establishing a positive connection between the two units. This device can be installed in already existing adjusting devices without further constructional modifications. The invention can be used particularly advantageously in devices associated to exhaust camshafts because the adjusting direction of the adjusting piston given by the drag and frictional torques of the camshaft acts in "retard" direction i.e., in a direction of large valve overlap. In this case, the adjusting piston should be held in its advance position during the starting of the internal combustion engine. The large valve overlaps which otherwise occur are extremely undesired especially when starting the internal combustion engine because, in this state of operation, there should be the largest possible amount of fresh gas in the cylinder. In the most unfavorable case, it can become impossible to start the engine. Because, in attempting to achieve small valve overlap by holding the adjusting piston in a predetermined position, the residual gas content in the cylinder is reduced, an additional positive contribution is made with regard to exhaust gas emission.

It is particularly simple to make the coupling means in the form of a piston or pin and have it extend in complementary bores of the drive and the driven unit. However, other coupling elements such as, for example, balls, wedges, needles and the like, and even indirectly loaded elements, are also conceivable.

In a further development of the invention, a hydraulic medium supply passage of a guide bushing for routing hydraulic medium to an end surface of the adjusting piston is simultaneously used as a supply passage for hydraulic medium for loading the coupling means. In this way, additional passages in the device can be dispensed with.

According to another feature of the present invention, a radial bore starting from the first lodging for the coupling means extends through the driven unit in front of the first end face of the coupling means. The radial bore serves as a flow-off bore for excess hydraulic medium out of the first lodging and to prevent the formation of an air cushion therein.

Finally, according to further features of the present invention, the coupling means extends in the first lodging in a bush section having a smaller diameter than said lodging and, at an end of the bush section nearer the first end face, the coupling means comprises a diameter enlargement, preferably in the form of a separate ring. Thus, a means for preventing loss of the coupling means is provided in its first lodging. This is important because, as a rule, the oil guide bushing is delivered as a part of the driven unit separately from the other components of the device and is mounted on the spot.

BRIEF DESCRIPTION OF THE DRAWING

The invention is represented in the drawing, in which:

FIGS. 1*a, b* show an upper and a lower partial longitudinal section through a device comprising a coupling arrangement of the invention.

DETAILED DESCRIPTION OF THE DRAWING

Figure 2:
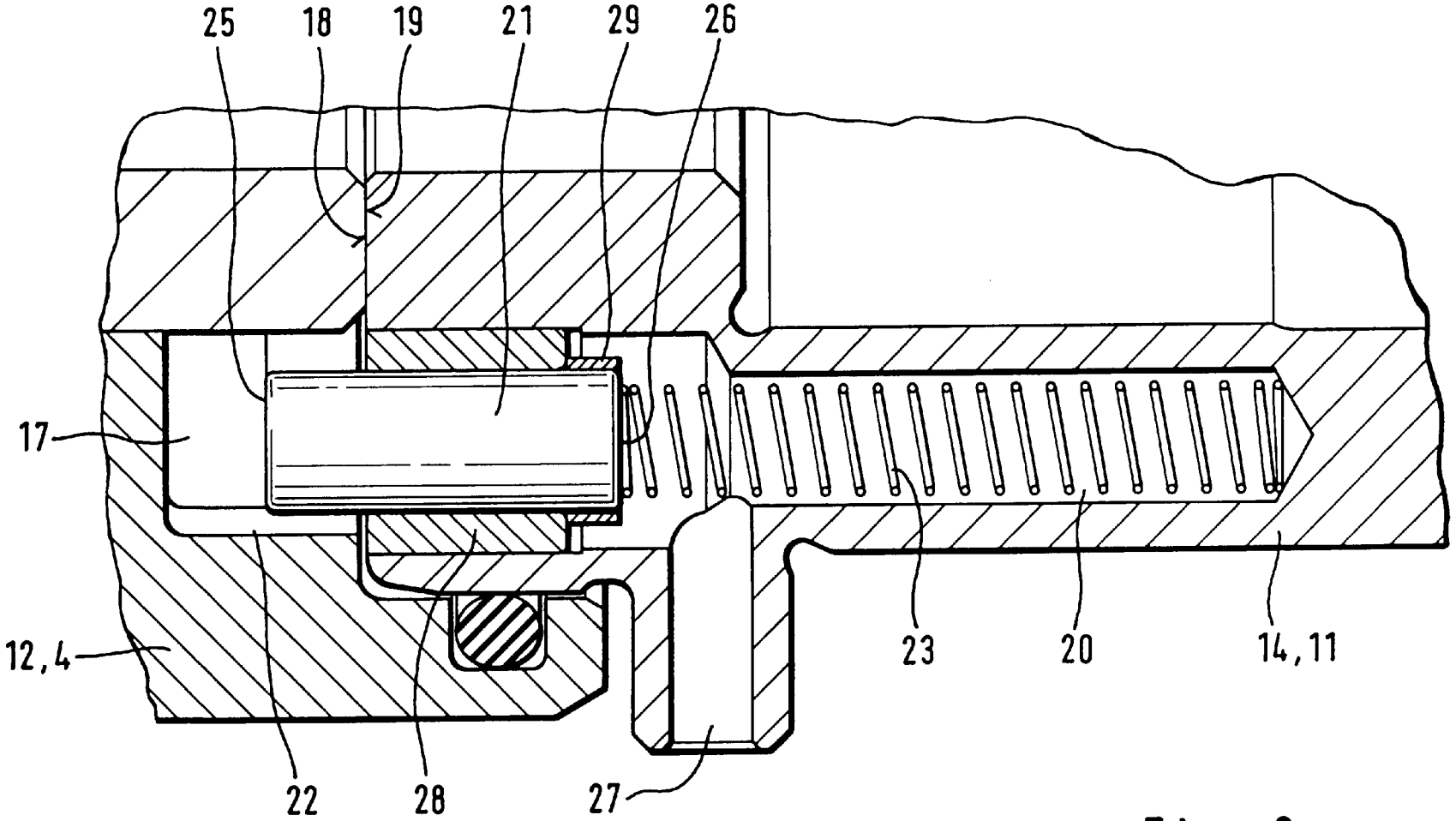
FIG. 2 shows an enlarged representation of the device in the region of its coupling arrangement.

The device 1, known, per se, in the technical field, comprises a drive pinion 2 which is in driving relationship with a crankshaft through a traction means, not shown. Radially inwards, the drive pinion 2 continues into an axial extension 3 extending in axial direction. This axial extension 3 is a part of a drive unit 4. The axial extension 3 comprises an inner gearing 6 which meshes with an outer, first section 5 of an adjusting piston 7. The adjusting piston 7 in turn, comprises a second, inner gear section 8. This section 8 engages an outer gearing 9 of a concentric bushing 10 which is an integral part of a driven unit 11.

A further axial extension 12 is associated to the axial extension 3 of the drive unit 4. The axial extension 12 is situated radially within the first axial extension 3 and extends in an annular recess 13 of the bushing 10. The drive unit 4 is thus supported relatively displaceable to the driven unit 11 including the bushing 10. A supply bushing 14 for hydraulic medium is rotationally fixed to the bushing 10. This supply bushing 14 surrounds end regions of a camshaft, not shown. In its annular region, the supply bushing 14 comprises at least one supply passage 15. Hydraulic medium is delivered through the supply passage 15 to an end surface 16 of the adjusting piston 7. At the same time, an annular space 17 for hydraulic medium is arranged in the axial extension 12. This annular space 17 is disposed directly in front of opposing end faces 18, 19 of the drive unit 4 and the driven unit 11.

A coupling or locking means 21 in the form of a piston extends in a first lodging 20 of the driven unit 11. A further lodging 22, delimited at one end by the annular space 17, is arranged in the region of the axial extension 12 of the drive unit 4. The coupling means 21 is loaded in coupling direction by the force of a spring means 23 in the form of a compression spring. A displacement of the coupling means in uncoupling direction is effected by the hydraulic medium pressure from the supply passage 15 and the annular space 17 which causes the coupling means 21 to no longer overlap the end faces 18, 19.

When, after switching-off of the internal combustion engine, the device 1 runs empty of hydraulic medium, the adjusting piston 7 is displaced by the force of a compression spring 24 into a preferred position (see introduction of description). At the same time, the spring means 23 displaces the coupling means 21 into a coupling position. To achieve this, the lodgings 20, 22 are arranged relative to each other so as to be aligned in the just mentioned rotational position of the units 4, 11. The coupling means 21 is thus partially displaced into the further lodging 22, and the units 4, 11 are positively coupled to each other. It now, the internal combustion engine is re-ignited, the adjusting piston 7, not being sufficiently supported hydraulically, tends to abut against its stop position at a high frequency by reason of the torsional vibrations of the camshaft. This is prevented by the invention as already mentioned by the fact that the drive and the driven units 4, 11 are positively coupled to each other during this starting phase. As soon as a sufficiently high hydraulic medium pressure has been built up on both sides of the adjusting piston 7, this hydraulic support prevents the said abutment and permits a displacement of the adjusting piston 7 in the desired direction. This build-up of pressure in the hydraulic medium which is likewise routed to a second end surface 25 of the coupling means 21 through the supply passage 15 and the annular space 17, causes the coupling means 21 to be displaced entirely into its first lodging 20. The physical coupling of the units 4, 11 is thus terminated.

It is likewise conceivable to use the measures of the invention in a device 1 associated to an exhaust camshaft. The compression spring 24 would then have to be installed in such a way that it acts on the adjusting piston 7 to oppose the drag and frictional torques of the camshaft which act in "retard" direction. As soon as the device has run empty of hydraulic medium, completely or to the largest possible extent, the compression spring 24 would displace the adjusting piston 7 into its "advance" stop position, and the force of the spring means 23 would again establish a positive coupling of the units 4, 11 in this stop position. The adjustment of the exhaust camshaft during the starting operation of the internal combustion engine in "advance" direction guarantees the desired small valve overlap and thus also a small amount of residual gas in the cylinder.

A radial bore 27 intersecting the first lodging 20 extends behind a first end surface 26 of the coupling means 21. This radial bore 27 serves to drain surplus hydraulic medium from the lodging 20 which collects as a leakage quantity during the loading of the coupling means 21. At the same time, the radial bore 27 serves to prevent the formation of an air cushion in the further lodging 22 The surplus hydraulic medium flows off through the radial bore 27 into the cylinder head. In the region of the coupling means 21, there is arranged in the further lodging 22, a separate ring 28 which surrounds the coupling means 21 and is made as a bushing section (see also FIG. 2). In the region of its part extending into the lodging 20, the coupling means 21 possesses a diameter enlargement 29 (configured in the present example as a separate ring). In this way, a simple security device against escape of the coupling means 21 out of the lodging 20 as well as a stop for the coupling means 21 are created.

Figure 3:
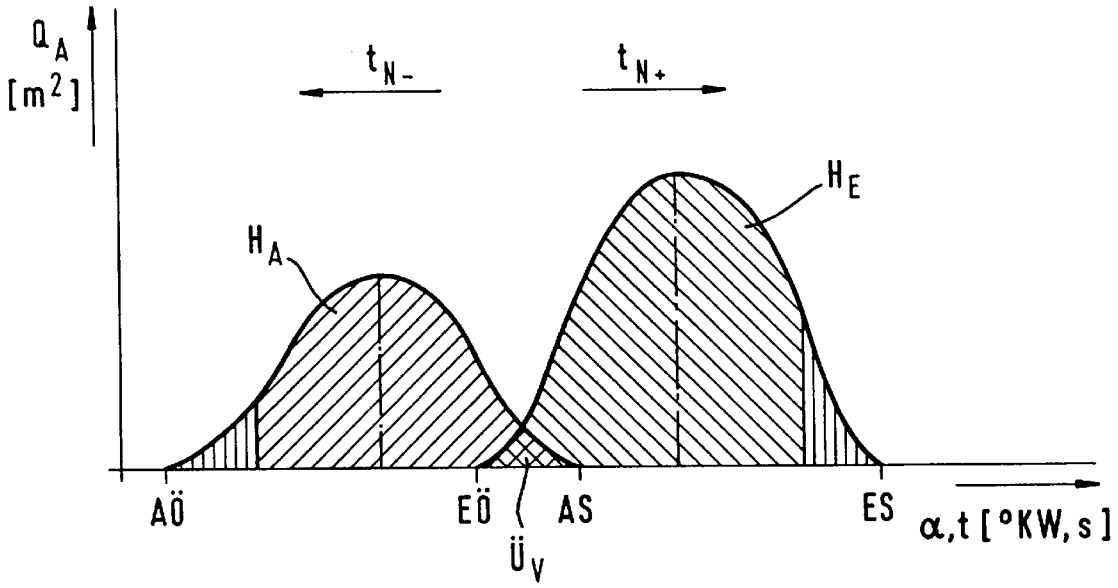
FIG. 3 shows a timing diagram of a four-stroke engine.

Finally, FIG. 3 shows a timing diagram of a four-stroke engine to better illustrate the gas exchange and valve overlap $\ddot{U}_v$ discussed in the foregoing.

We claim:

1. A device (1) for varying the opening and closing times of gas exchange valves of an internal combustion engine, which device (1) is disposed within a control gear of at least one inlet or exhaust camshaft mounted in a cylinder head, said device (1) being arranged on a drive pinion (2) which is in driving relationship with the camshaft, said device (1) comprising an adjusting piston (7) which is axially displaceable by hydraulic medium and possesses two helical gear sections (5, 8), the first of which sections (5) cooperates with a complementary gearing (6) of a drive unit (4) which is rotationally fixed to the drive pinion (2), and the second helical gear section (8) cooperates with a complementary gearing (9) of a driven unit (11) which is rotationally fixed to the camshaft, the drive and the driven units (4, 11) comprising opposing end surfaces (18, 19), wherein at least one coupling means (21) extends in a first lodging (20) in one of the two units (11, 4) in the region of the opposing end surfaces(18, 19), in the other of the two units (4, 11), there is arranged a further lodging (22) into which the coupling means (21)

can be partly displaced in one relative rotational position of the units (4, 11) by the force of a spring means (23), the coupling means (21) can be displaced in an uncoupling direction into the first lodging (20) with servo assistance by hydraulic medium.

2. The device of claim 1, wherein, when the device (1) is used with an intake camshaft, the lodgings (20, 22) are aligned to each other in an end position of the adjusting piston (7) corresponding to a "retarded" opening and closing of the gas exchange valves, and wherein, when the device (1) is used with an exhaust camshaft, the lodgings (20, 22) are aligned to each other in an end position of the adjusting piston (7) corresponding to an "advanced" opening and closing of the gas exchange valves.

3. The device of claim 1, wherein the coupling means (21) is configured as a piston or pin which extends in the lodgings (20, 22) which are configured as bores, the spring means (23) being made in the form of at least one coil spring.

4. The device of claim 1, wherein the first lodging (20) for the coupling means (21) is integrated in the driven unit (11) and the further lodging (22) is integrated in the drive unit (4), the spring means (23) is installed in the first lodging (20) and acts in a coupling direction on a first end surface (26) of the coupling means (21), and an annular space (17) is arranged in front of the further lodging (22), through which annular space (17) the hydraulic medium from a supply passage (15) can be led in the uncoupling direction to a second end surface (25) of the coupling means (21).

5. The device of claim 1, wherein at least a part of the driven unit (11) serves as a supply bushing (14) for the hydraulic medium.

6. The device of claim 5, wherein a supply passage (15) for the hydraulic medium is an integral part of the supply bushing (14) and communicates with the annular space (17) in the region of the opposing end surfaces (18, 19).

7. The device of claim 6, wherein the supply passage (15) supplying hydraulic medium to the annular space (17) simultaneously serves as a supply passage (15) for supplying hydraulic medium to an end surface (16) of the adjusting piston (7).

8. The device of claim 1, wherein the drive unit (4) comprises a first axial extension and a radially inner second axial extension (12) arranged concentric to the first axial extension (3) and relatively rotatable in an annular recess (13) of a bushing (10) which is rotationally fixed to the driven unit (11) while being an integral part thereof; said bushing (10) comprising the gearing (9) which is complementary to the second helical gear section (8).

9. The device of claim 5, wherein a radial bore (27) starting from the first lodging (20) for the coupling means (21) extends through the driven unit (11) in front of the first end surface (26) of the coupling means (21).

10. The device of claim 1, wherein the coupling means (21) extends in the first lodging (20) in a bushing section (28) having a smaller diameter than said lodging (20) and, at an end of the bushing section (28) nearer the first end surface (26), the coupling means (21) comprises a diameter enlargement (29).

11. The device of claim 10, wherein the diameter enlargement (29) is made as a separate ring.

12. The device of claim 1 wherein the helical gear sections (5, 8) of the adjusting piston (7) are oppositely oriented.

13. The device of claim 1 wherein the at least one coupling means (21) is arranged parallel to the longitudinal axis of the camshaft.

* * * * *